US007651553B2

(12) United States Patent
Pletcher et al.

(10) Patent No.: US 7,651,553 B2
(45) Date of Patent: Jan. 26, 2010

(54) BALLAST CIRCUIT FOR ELECTROSTATIC PARTICLE COLLECTION SYSTEMS

(75) Inventors: Timothy Allen Pletcher, Eastampton, NJ (US); Steven Warshawsky, Staten Island, NY (US)

(73) Assignee: Sarnoff Corporation, Princeton, NJ (US)

( * ) Notice: Subject to any disclaimer, the term of this patent is extended or adjusted under 35 U.S.C. 154(b) by 425 days.

(21) Appl. No.: 11/540,454

(22) Filed: Sep. 29, 2006

(65) Prior Publication Data

US 2007/0068387 A1 Mar. 29, 2007

Related U.S. Application Data

(60) Provisional application No. 60/722,078, filed on Sep. 29, 2005.

(51) Int. Cl.
*B03C 3/60* (2006.01)

(52) U.S. Cl. ..... 96/83; 96/84; 96/95; 96/97; 264/104

(58) Field of Classification Search ..... 96/69, 96/83, 84, 88, 95–100; 264/104
See application file for complete search history.

(56) References Cited

U.S. PATENT DOCUMENTS 2,239,694 A * 4/1941 Bennett ..... 315/111.01
2,279,586 A * 4/1942 Bennett ..... 315/111.91
4,265,641 A * 5/1981 Natarajan ..... 95/79
4,339,782 A * 7/1982 Yu et al. ..... 96/62
4,472,756 A 9/1984 Masuda
4,477,263 A * 10/1984 Shaver et al. ..... 95/7
5,024,685 A 6/1991 Torok et al.
5,137,552 A 8/1992 Sasaki
5,180,404 A 1/1993 Loreth et al.
5,667,563 A * 9/1997 Silva, Jr. ..... 96/50
5,707,428 A * 1/1998 Feldman et al. ..... 96/54
5,733,360 A * 3/1998 Feldman et al. ..... 95/78
5,792,243 A * 8/1998 Meffert et al. ..... 96/83
6,004,375 A * 12/1999 Gutsch et al. ..... 95/57
6,241,810 B1 6/2001 Wikstrom et al.
6,527,829 B1 * 3/2003 Malkamaki et al. ..... 95/71
6,558,456 B2 * 5/2003 Nissinen ..... 96/39
6,632,267 B1 * 10/2003 Ilmasti ..... 95/59
7,062,982 B2 * 6/2006 Coyle et al. ..... 73/863.23

(Continued)

FOREIGN PATENT DOCUMENTS

EP 0072862 6/1989

(Continued)

OTHER PUBLICATIONS

PCT/US06/38445 International Search Report, May 3, 2007.

*Primary Examiner*—Richard L Chiesa
(74) *Attorney, Agent, or Firm*—Lowenstein Sandler PC

(57) ABSTRACT

The present invention provides a ballast circuit and method for fabricating the same for multi-electrode corona discharge arrays. The circuit includes a conductive plastic material and at least one corona electrode protruding from the conductive plastic material. The distance between the plastic material and the corona electrode varies and controls the electrical resistance and determines the voltage breakdown of the circuit. Additionally, a particle collection surface may preferably be located within the conductive plastic material or preferably be separated from the material depending on the circuit design and configuration.

17 Claims, 2 Drawing Sheets

U.S. PATENT DOCUMENTS

| | | | | |
|---|---|---|---|---|
| 7,130,178 | B2 | 10/2006 | Pletcher et al. | |
| 7,261,764 | B1 * | 8/2007 | Pletcher | 95/58 |
| 2004/0069047 | A1 * | 4/2004 | Coyle et al. | 73/28.04 |
| 2004/0179322 | A1 * | 9/2004 | Pletcher et al. | 361/226 |
| 2006/0018812 | A1 * | 1/2006 | Taylor et al. | 422/186.04 |
| 2007/0209507 | A1 * | 9/2007 | Pletcher | 95/58 |

FOREIGN PATENT DOCUMENTS

| | | | | |
|---|---|---|---|---|
| JP | 5-154409 A | * | 6/1993 | 96/97 |

* cited by examiner

BALLAST CIRCUIT FOR ELECTROSTATIC PARTICLE COLLECTION SYSTEMS

CROSS-REFERENCE TO RELATED APPLICATIONS

This application claims the benefit of U.S. Provisional Patent Application No. 60/722,078 filed Sep. 29, 2005, the entire disclosure of which is incorporated herein by reference.

FIELD OF THE INVENTION

The invention relates generally to electrostatic particle collection systems, and more specifically to methods for fabricating ballast circuits for multi-electrode corona discharge arrays in electrostatic particulate collection systems.

BACKGROUND OF THE INVENTION

Highly efficient, low power particle collection devices have been demonstrated using multiple electrode corona discharge arrays. The advantages of multiple electrode corona discharge arrays for particle collection are described in "System and Method for Spatially Selective Particulate Deposition And Enhanced Particulate Deposition Efficiency", filed Apr. 18, 2006, having an application Ser. No. 11/405,787, issued as U.S. Pat. No. 7,261,764, and in "Corona Charging Device and Methods", filed Mar. 11, 2003 having an application Ser. No. 10/386,252, issued as U.S. Pat No. 7,130,178, and in "Method And Apparatus for Concentrated Airborne Particle Collection", filed Jun. 24, 2003, having an application Ser. No. 10/603,119 issued as U.S. Pat. No. 7,062,982 all of which are herein incorporated by reference.

A key circuit element needed for the proper operation of multiple electrode corona discharge arrays is a resistor electrically connected in series between the high voltage DC power supply and each corona electrode. This resistor is known as a ballast resistor. The main function of the ballast resistor is to limit the current through any individual corona electrode when the plasma is initiated and while operating at steady state.

The voltage at which an electrical discharge is initiated is known to vary for each corona electrode in a multiple electrode system. Furthermore, the resistance of the air following the initial electrical discharge lowers dramatically such that the voltage needed to sustain the discharge is significantly lower than the initial breakdown voltage. Given these factors, it is therefore possible to deliver all electrical power to the corona discharge through a single or small number of electrodes. The resulting non-uniform plasma would defeat the primary benefits of a multiple electrode corona discharge system; that is, uniformity of electric field and charge density in the particle collection zone.

Providing a ballast resistor for each corona electrode solves the plasma non-uniformity problem by limiting the power delivered to any single corona electrode. Power through a single electrode is limited by lowering the electrode voltage as more current passes through the ballast resistor to the electrode. The ballasting effect allows the power supply voltage to adjust to a voltage where other electrodes will initiate and sustain continuous plasma.

This ballasting function places a number of electrical requirements onto the ballast resistor. The two key requirements are voltage breakdown between the resistor terminals and the resistance value. These requirements vary with electrode geometry and plasma power density. The value for the voltage breakdown of the ballast resistor used for the electrostatic radial geometry particle concentrator at is typically 9 kV. The resistance value for each of the ballast resistor used for this concentrator is 2 Gohm.

Resistors having the above characteristics are produced commercially. However, the breakdown and resistance values are not usually in high demand for most electrical applications. As a result, these resistors are typically much more expensive than lower voltage, lower value resistors. As an example, a 50V, 100 kohm resistor in a surface mount package can usually be purchased for less than $0.01. The 10 KV, 1 Gohm resistors used in the radial collector are purchased in small quantities for about $1.00. For most commercial and industrial particle collection applications, the number of electrodes needed is typically greater than thirty and less than five hundred. The cost the plastic material needed to produce an equivalent of 108 1 Gohm, 10 kV resistors is about $0.50 yielding a 216× improvement in cost.

Thus, there remains a need in the art for a highly-efficient, geometrically flexible and cost-effective material that provides for the resistive ballasting of multi-corona discharge arrays.

SUMMARY OF THE INVENTION

The present invention provides a ballast circuit for an electrostatic particle collection system and the method for fabricating the same. The circuit comprises a conductive plastic material having a first end and a second end, such that the first end is connected to a power source. The circuit also comprises at least one corona electrode protruding from the second end of the conductive plastic material.

In one embodiment, a radial configured ballast circuit for an electrostatic particle collection system comprises a conductive plastic material having an inner surface and an outer surface, such that the outer surface is connected to a power source. The circuit also comprises at least one corona electrode protruding from the inner surface of the conductive plastic material, wherein distance between the inner surface of the conductive plastic material and the corona electrode varies electrical resistance and determines the voltage breakdown of the circuit.

In another embodiment, a planer configured ballast circuit for an electrostatic particle collection system comprises a conductive plastic material having a top surface and a bottom surface such that the top surface is connected to a power source. The circuit also comprises at least one corona electrode protruding from the bottom surface of the conductive plastic material, wherein distance between the top surface of the conductive plastic material and the corona electrode varies electrical resistance and determines the voltage breakdown of the circuit.

DETAILED DESCRIPTION OF THE INVENTION

As will be described in greater detail below, a conductive plastic material has been shown to meet the requirements for the resistive ballasting of multi-electrode corona discharge arrays. Typical ballast resistor electrical requirements are resistance greater than or equal to 10.sup9 ohm and voltage breakdown of greater than or equal to 10 kV across the terminals. Conductive plastics possess a unique combination of material properties that enable its use for this application. Use of this material will substantially reduce the cost to manufacture multi-electrode corona discharge arrays where a large number (i.e. >10 electrodes) of discharge elements is required.

Furthermore, using a conductive plastic as the resistive element of a multi-electrode ballast circuit enables a large number of circuit designs and geometries that can be used to accommodate the variations of particle collection geometry. A brief description of the multi-electrode ballast circuit for cylindrical and planer configurations are provided herein below with respect to FIGS. 1A, 1B and FIGS. 2A and 2B respectively.

Figure 1A:
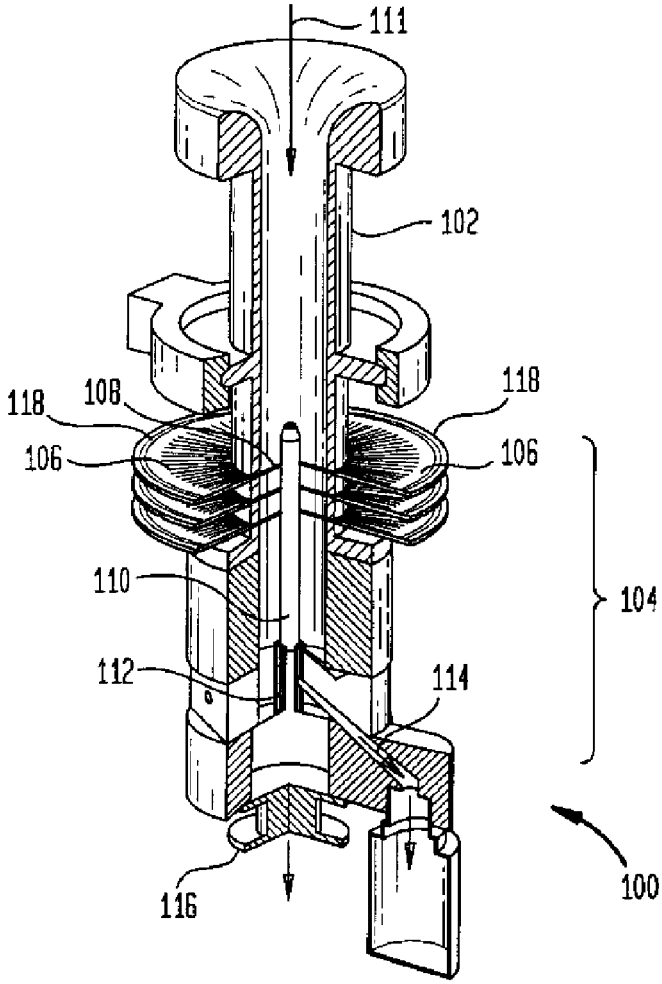
FIG. 1A is a schematic diagram illustrating electrostatic particle collection device according to an embodiment of the present invention.

Referring to FIG. 1A there is shown a schematic diagram illustrating electrostatic particle collection ballast device 100 according to an embodiment of the present invention. Note that this diagram is a schematic representation of a radial configuration of the device 100 and the device may preferably be constructed with other geometric configurations. Device 100 comprises a body 102 preferably of polycarbonate or similar mechanical grade plastic material, with a multi- electrode ballast circuit 104 disposed on the body 102. The circuit 104 having a conductive plastic 106 as a resistive element partially surrounding the device body 102. The circuit 104 further includes a corona array of corona electrodes 108 protruding from the conductive plastic 106 as shown in FIG. 1A. Also, included is a collection surface 110, preferably having a columnar shape, made of a conductive material, concentrically positioned with respect to the corona electrodes 108. The collection surface 110 is situated opposed to the corona electrodes 108. The collection surface 110 provides an area to initiate and sustain the electrical corona discharge from the corona electrodes 108. The arrow 111 on the top of the device 100 indicates the direction of the flow of particle-laden air through the device. Additionally, shown is a hydrosol extraction unit 112 which pumps water to the center of the collection column 110 and then the water flows off from the collection column 110 to drain out the collected aerosol particulates as shown by the arrows 114 as shown in FIG. 1A. Also, shown is a fan 116 which is used to draw in the ambient air through the device. A connection to a high voltage power supply (not shown) is made to the conductive plastic material, 106, by a wire (not shown) connected to a conductive ring 118, such as a strip of conductive tape or thin metal, that attaches to the surface of conductive plastic 106 as shown in FIG. 1A.

Figure 1B:
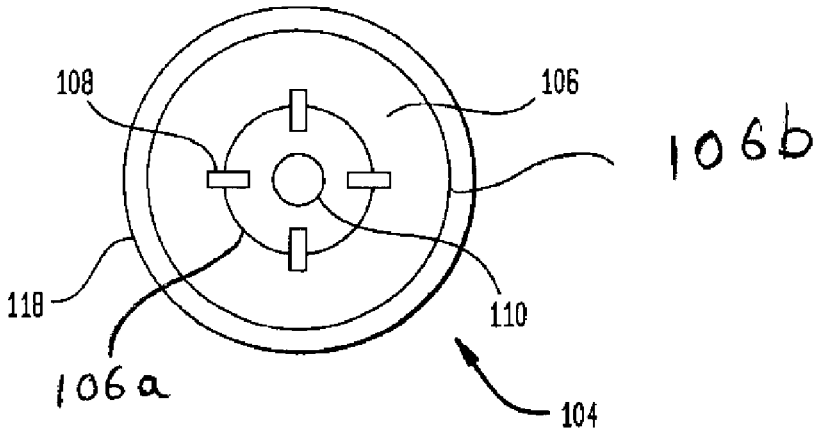
FIG. 1B is a schematic diagram illustrating cross-section of the circuit of FIG. 1A according to one embodiment of the present invention.

Referring to FIG. 1B is a schematic representation of a cross-section of the ballast circuit 104 of the device taken 100 through the corona electrodes 108 in FIG. 1A. Note, the ballast circuit 104 is configured to be of radial shape. Thus, this ballast circuit 104 can preferably be used for radial particle collector configurations. As shown in FIG. 1B is the conductive plastic 106 is shown as doughnut shape having an inner surface 106*a* and an outer surface 106*b*. The conductive plastic material 106 may preferably be acetyl, polycarbonate, or polystyrene. Also, four corona electrodes 108 are shown embedded or firmly enclosed in the conductive plastic 106 protruding from the inner surface of the conductive plastic. Although only four electrodes are shown as an example in the figure, more or less than four electrodes can preferably be enclosed in the conductive plastic. The electrodes 108 in this radial configuration are equally spaced from the conductive plastic material 106. As shown in FIG. 1B, the particle collection post 110 is firmly situated within the conductive plastic 106 as shown. The collection post 110 is a conductive material that is concentrically positioned with respect to the corona electrode 108. It is electrically connected to a voltage near electrical ground and is used from the electric field between its surface and the tips of the corona electrode. The electric field is needed to initiate and sustain the electrical corona discharge. The post electrode also provides a surface upon which the captured particles will land. The connection to the high voltage DC power supply (not shown) is preferably provided from the outer surface 106*b* of the conductive plastic 106 via a high voltage conductive ring 118 as shown in FIG. 1B. Note that the connection is preferably an insulating connection for providing a safe electrical operation.

As discussed above, the schematic shows only four corona electrodes, however, the number of corona electrodes is normally much greater than four. Typical design rules allow a minimum pitch between corona electrodes of approximately 0.1 inch. Additionally, the schematic also shows a single level of corona electrodes, however, multiple levels of corona electrodes may preferably be used for some applications of particle collection.

The key design parameter for the configuration of FIG. 1B is the distance from the outer surface 106*b* of the conductive plastic 106 to the corona electrode 108 surface that will be embedded into the plastic 106. This distance provides a penetration depth of corona electrode 108 into the conductive plastic material 106. The greater penetration depths produce lower values of ballast/electrical resistance. The distance comprises in the range between about 0.01 inches and about 0.5 inches. The distance will preferably be typically greater than 0.1 inch and less than 0.5 inches. This distance is controlled preferably during manufacture of the ballast resistor assembly 104. This distance will vary the electrical resistance between the outer surface 106*b* of the conductive plastic 106 and each corona electrode 108 and will also determine the voltage breakdown of the device 100.

Other design parameters preferably include bulk resistivity of the conductive plastic, shape and orientation of power supply connection to plastic and as discussed above, option to insulate power supply connection. Bulk resistivity will preferably range typically between $10^8$ ohm-cm-$10^{10}$ ohm-cm By varying the bulk resistivity of the conductive plastic, the bulk resistance and the voltage breakdown can be controlled. Higher bulk resistivities will produce higher ballast resistivities given identical geometries. Higher bulk resistivities will also produce higher breakdown voltages across the material. This is due to the fact that most materials have a breakdown voltage that is a nonlinear function of voltage. That is, if the voltage across the material is raised beyond the material's breakdown voltage, the current passing through the device will increase significantly for small changes in voltage, like a diode. Conductive plastics in the bulk resistivity range applicable to this application are primarily the pure plastic with a small amount of conductive doping material. Pure plastics such as acetyl, polycarbonate, and polystyrene have high breakdown voltages. This property is significantly lowered when conductive dopants are added to the pure material. Therefore, higher bulk resistivity materials tend to have higher breakdown voltage properties. Also, by varying penetration depth of power supply contact/connection into the conductive plastic, the bulk resistance can be varied/controlled. The penetration depth of the power supply connection is the distance from the power supply connection to the conductive plastic which is preferably typically greater than 0.1 inch and less than 0.5 inches. As mentioned above, the greater penetration depths produce lower values of ballast resistance. Furthermore, patterning the power supply connection in various shapes and orientations, the bulk resistance of the ballast circuit can preferably be controlled. For example, connecting at multiple points along the perimeter of the plastic material or varying the penetration connection distance and width and/or length of the connection surface can increase or decrease the bulk resistivity.

Figure 2A:
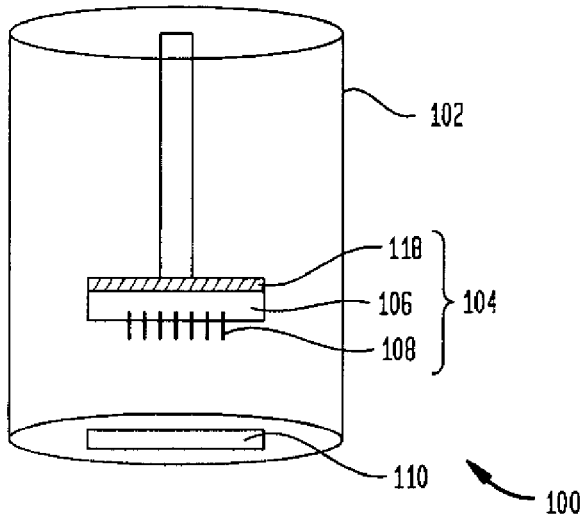
FIG. 2A is a schematic diagram illustrating electrostatic particle collection device according to another embodiment of the present invention.

Referring to FIG. 2A there is shown a schematic diagram illustrating an electrostatic particle collection ballast device 100 according to an embodiment of the present invention. Note that this diagram is a schematic representation of a planer configuration of the device 100 and the device may preferably be constructed with other geometric configurations. Device 100 comprises a body 102 preferably of polycarbonate or similar mechanical grade plastic material, with a multi-electrode ballast circuit 104 disposed preferably inside the device body 102. The circuit 104 having a conductive plastic 106 as a resistive element with an corona array of corona electrodes 108 protruding from the conductive plastic 106 as shown in FIG. 2A. Also, included is a collection surface 110, preferably a plate having a planar surface, preferably made of a conductive material, separated from the conductive plastic 106 as shown. The collection plate 110 is situated across from the conductive plastic 106, preferably opposed to the corona electrodes 108 as shown in FIG. 2A. In this embodiment, there is a separate structure (not shown) that positions or supports the plate 110 with respect to the conductive plastic 106 and the corona electrodes 108. The collection surface 110 provides an area to initiate and sustain the electrical corona discharge from the corona electrodes 108. Also, shown is the planar conductor, such as conductive tape or a thin metal strip 118, covering the conductive plastic 106 as shown, to provide a connection to the power supply (not shown) via a high voltage wire (not shown).

Figure 2B:
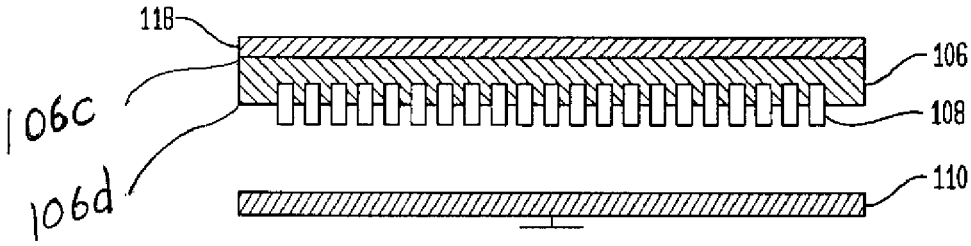
FIG. 2B is a schematic diagram illustrating cross-section of the circuit of FIG. 2A according to another embodiment of the present invention.

Referring to FIG. 2B, there is shown a schematic representation of a cross-section of the ballast circuit 104 in the device 100 taken through the corona electrodes 108 in FIG. 2A. Note, the ballast circuit 104 is configured to be of planer shape. Thus, this ballast circuit 104 can preferably be used for planer particle collector configurations. As shown in FIG. 2B, is the conductive plastic 106 also preferably of planer shape having a top surface 106*c* and a bottom surface 106*d*. Additionally, twenty-one corona electrodes 108 are shown protruding from the bottom surface 106*d* of the conductive plastic 106. Although, twenty one electrodes are shown as an example in the figure, more or less than twenty-one electrodes can preferably be enclosed in the conductive plastic. The electrodes 108 in this planar configuration are equally spaced from each other. The configuration shown in FIG. 2B, illustrates the particle collection plate 110 preferably of planer shape is separated from the conductive plastic 106. The connection to the high voltage DC power supply is preferably made through the top surface 106*c* of the conductive plastic 106 via the high voltage conductive tape/strip 118 as shown in FIG. 1B. Note that the connection is preferably an insulating connection for providing a safe electrical operation.

As discussed above, the schematic shows only twenty-one corona electrodes, however, the number of corona electrodes is normally much greater. Typical design rules allow a minimum pitch between corona electrodes of approximately 0.1 inch. Moreover, the schematic also shows a single level of corona electrodes, however, multiple levels of corona electrodes will be used for some applications of particle collection.

The key design parameters for this configuration is the distance from the top surface 106*c* of the conductive plastic 106 to the corona electrode 108 surfaces that will be embedded into the plastic. Similar to the radial configuration described with respect to FIG. 2A, this distance of the planer configuration in FIG. 2B provides a penetration depth of corona electrode 108 into the conductive plastic material 106. The greater penetration depths produce lower values of ballast/electrical resistance. The distance comprises in the range between about 0.01 inches and about 0.5 inches. The distance will preferably be typically greater than 0.1 inch and less than 0.5 inches. This distance will be controlled during the construction of the ballast circuit assembly 104. This distance will vary the electrical resistance between the outer surface 106*c* of the conductive plastic 106 and each corona electrode 108 and will thus determine the voltage breakdown of the device 100.

Other design parameters include bulk resistivity of plastic, shape and orientation of power supply connection to plastic and as described above option to insulate power supply connection. As described above with respect to the radial configuration in FIG. 1A, the bulk resistivity for the planer configuration in FIG. 1B will preferably range typically between $10^8$ ohm-cm-$10^{10}$ ohm-cm. By varying the bulk resistivity of the conductive plastic, the bulk resistance and the voltage breakdown can be controlled.

Although the present invention describes only radial and planer configurations of the ballast circuits, note that other geometrical configurations may also be provided to accommodate the variations of particle collection geometry provided the configuration maintains the constraints required by the electrostatic particle collection device. Even though various embodiments that incorporate the teachings of the present invention have been shown and described in detail herein, those skilled in the art can readily devise many other varied embodiments that still incorporate these teachings without departing from the spirit and the scope of the invention.

The invention claimed is:

1. A ballast circuit for an electrostatic particle collection system, the circuit comprising:

a conductive plastic material having a first end and a second end, wherein said first end is connected to a power source; and at least one corona electrode protruding from the second end of the conductive plastic material.

2. The circuit of claim 1 further comprising a particle collection surface situated opposed to the at least one corona electrode.

3. The circuit of claim 2 wherein said collection surface is concentrically positioned with respect to the corona electrodes.

4. The circuit of claim 2 wherein said collection surface is positioned separate from the plastic material.

5. The circuit of claim 2 wherein said particle collection surface comprises a conductive material.

6. The circuit of claim 1 further comprising a conductive metal coupled to the first end of the conductive plastic material to provide for the connection to the power source.

7. The circuit of claim 1 wherein distance between the plastic material and the corona electrode comprises in the range between about 0.01 inches and about 0.5 inches.

8. The circuit of claim 1 wherein bulk resistivity of the conductive plastic material comprises in the range between about $10^8$ ohm-cm and about $10^{10}$ ohm-cm.

9. A planer configured ballast circuit for electrostatic particle collection, the circuit comprising:

a conductive plastic material having a top surface and a bottom surface, said top surface connected to a power source; and at least one corona electrode protruding from the bottom surface of the conductive plastic material, wherein distance between the top surface of the conductive plastic material and the corona electrode varies electrical resistance and determines the voltage breakdown of the circuit.

10. The circuit of claim 9 further comprising a particle collection plate situated opposed to the corona electrodes, said plate is separated from the conductive plastic material,

11. The circuit of claim 9 further comprising a conductive metal coupled to the top surface of the conductive plastic material; said metal provides for the connection to the power source.

12. A method of constructing a ballast circuit for multi-electrode corona discharge arrays for an electrostatic particle collection, the method comprising:

providing a conductive plastic material having a first end and a second end, said second end connected to a power source; and embedding at least one corona electrode into the first end of the conductive plastic material.

13. The method of claim 12 further comprising placing a particle collection surface situated opposed to the at least one corona electrode.

14. The method of claim 13 wherein said collection surface is concentrically positioned with respect to the corona electrodes.

15. The method of claim 13 wherein said collection surface is positioned separate from the plastic material.

16. The method of claim 12 further comprising varying penetration depth of corona electrodes, said penetration depth comprises distance between the corona electrode and the first end of the conductive plastic material.

17. The method of claim 12 further comprising varying resistivity of the conductive plastic material; said resistivity comprises amount of conductive dopant in the conductive plastic material.

* * * * *